United States Patent [19]

Hanyu

[11] 4,375,198

[45] Mar. 1, 1983

[54] HEMSTITCHING METHOD OF SEWING MACHINE

[75] Inventor: Susumu Hanyu, Hachioji, Japan

[73] Assignee: Janome Sewing Machine Co. Ltd., Tokyo, Japan

[21] Appl. No.: 226,152

[22] Filed: Jan. 19, 1981

[30] Foreign Application Priority Data

Jan. 21, 1980 [JP] Japan ..... 55-4516

[51] Int. Cl.[3] ..... D05B 1/20

[52] U.S. Cl. ..... 112/269.1

[58] Field of Search ..... 112/269.1, 432, 433, 112/162, 158 R, 158 A, 172,. 177

[56] References Cited

U.S. PATENT DOCUMENTS 4,155,320 5/1979 Aubort ..... 112/269.1

4,250,824 2/1981 Meier et al. ..... 112/162 X

*Primary Examiner*—Peter P. Nerbun

*Attorney, Agent, or Firm*—Michael J. Striker

[57] ABSTRACT

A method of producing hemstitches by means of a zig-zag stitching presser foot comprises the steps of forming two fixing stitches at one point adjacent an edge of the fabric with feeding of the fabric in one direction while reciprocating the needle a small distance laterally, two stitches laterally spaced apart from each other and from the fixing stitches and formed with feeding the fabric in the one direction without lateral movement of the needle, and two crossing stitches interconnecting the fixing stitches with the lateral stitch remote from the one point and being formed with feeding the fabric in the opposite direction.

3 Claims, 8 Drawing Figures

HEMSTITCHING METHOD OF SEWING MACHINE

BACKGROUND OF THE INVENTION

The invention relates to a hemstitching method of a sewing machine, particularly of a zigzag stitching sewing machine producing the lock stitches in the sewn material with the upper and lower threads.

The conventional hem-stitches have been produced by a zigzag sewing machine provided with a specific attachment in place of a generally used zigzag stitching presser foot. Thus the conventional hemstitching requires a troublesome work for exchanging the presser foot and also an additional attachment obtained at the expense of a considerable production cost, including a material as well as economical loss. In addition the conventional hem-stitches are liable to be deformed and lose the hemming effect as will be mentioned hereinlater in reference to the attached drawings.

SUMMARY OF THE INVENTION

An object of this invention is to eliminate the defects and disadvantages of the prior art, and it is a primary object of the invention to provide beautiful and effective hem-stitches with the generally used zigzag stitching presser foot, instead of employing a separate specific attachment.

The other features and advantages of the invention will be apparent from the following description of the embodiments in reference to the attached drawings.

DESCRIPTION OF THE PREFERRED EMBODIMENTS

Figure 1A:
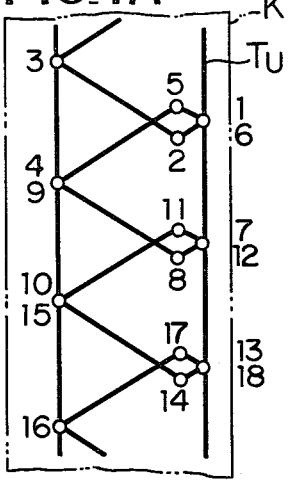
FIGS. 1A, 1B and 1C are, respectively plan views indicating three embodiments of hem-stitches of the invention.

In FIGS. 1A–3B, the reference mark K indicates a fabric to be sewn, and the reference mark Tu indicates an upper thread while the lower thread is not shown. The reference in the form of small circles show the interlocking points of stitches, and the reference numerals 1, 2, 3, 4, . . . show the sequence of stitches. FIGS. 1A, 1B and 1C show the hem-stitches, in which the right side row stitches are located inside of the edge of the sewn fabric K. On the other hand, FIGS. 2A, 2B and 2C show the hem-stitches, in which the right side row of stitches are located just outside the edge of the sewn fabric K.

Figure 3A:
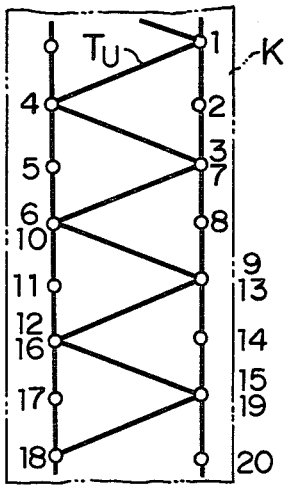
FIG. 3A PRIOR ART
FIGS. 3A and 3B are plan views indicating the conventional embodiments of hem-stitches.
Figure 3B:
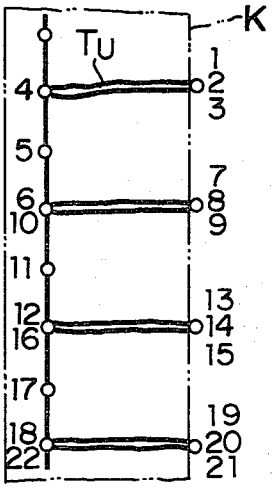
FIG. 3B PRIOR ART

FIG. 3A shows the conventional hem-stitches, in which the right side rows of stitches are located inside the edge of the sewn fabric, and FIG. 3B shows the hem-stitches of FIG. 3A, in which the right side row of stitches are located just outside the sewn fabric K. As is seen, a problem arises in the hem-stitches of FIG. 3B. Namely, the groups of three stitches are concentrated to the points each opposite to the fixed leftside row of stitches respectively. Therefore the laterally connected threads Tu are slackened. Further, since the groups of three stitches (1, 2, 3; 7, 8, 9; 13, 14, 15; . . . ) are not connected to each other by the vertical threads along the edge of the sewn fabric, these groups of three stitches are not fixed and are liable to vertically move along the edge of the fabric, and therefore the fabric edge will come to be frayed. Thus the hem-stitches in FIG. 3B will lose the substantial hemming effect.

In contrast to the prior methods of hem-stitching as shown in FIG. 3A and 3B the methods of the invention as shown in FIGS. 1A through 2B will provide a more reliable and beautiful hemming effect. According to the embodiments of the invention shown in FIG. 1A and FIG. 2A, the stitch from 1 to 2 is produced with the forward feeding operation of the sewing machine. The stitch from 2 to 3 is produced with the rearward feeding operation. The stitch from 3 to 4 is produced with the forward feeding operation. The stitch from 4 to 5 is produced with the rearward feeding operation. The stitches from 5 to 6 and 7 are produced with the forward feeding operation. Such a sequence of stitches are produced in one cycle operation of the sewing machine which is repeated.

Figure 1B:
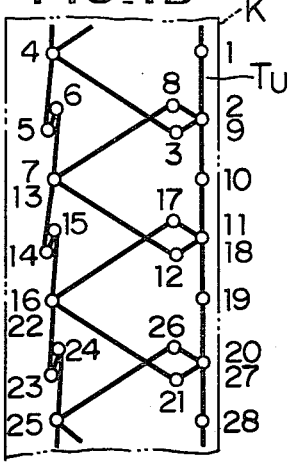
Figure 2A:
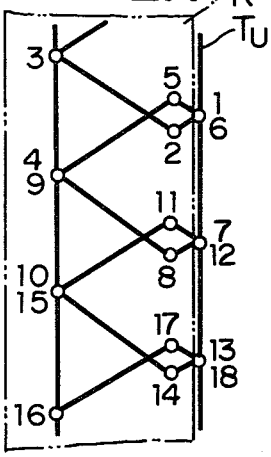
FIGS. 2A, 2B and 2C are plan views indicating the other three embodiments of hem-stitches of the invention.
Figure 2B:
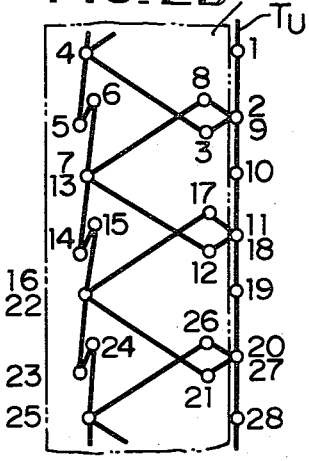

According to the embodiments of the invention shown in FIG. 1B and FIG. 2B, the stitches from 1 to 2 and 3 are produced with the forward feeding operation of the sewing machine. The stitch from 3 to 4 is produced with the rearward feeding operation. The stitch from 4 to 5 is produced with the forward feeding operation. The stitch from 5 to 6 is produced with the rearward feeding operation. The stitch from 6 to 7 is produced with the forward feeding operation, and the stitch from 7 to 8 is produced with the rearward feeding operation. Then the stitches from 8 to 9 and 10 are produced with the forward feeding operation. Such a sequence of stitches are produced in one cycle operation of the sewing machine which is repeated as well.

Figure 1C:
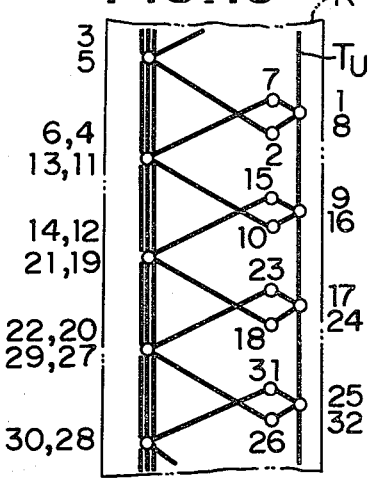
Figure 2C:
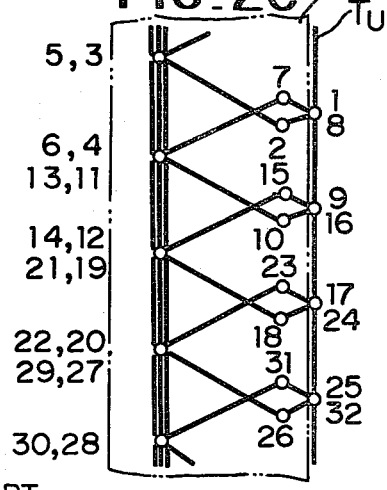

According to the embodiments of the invention shown in FIG. 1C and FIG. 2C, the stitch from 1 to 2 is produced with the forward feeding operation of the sewing machine. The stitch from 2 to 3 is produced with the rearward feeding operation. The stitches from 3 to 4, 5 and 6 are produced with the forward, rearward and forward feeding operations respectively. Then the stitches from 6 to 7, 8 and 9 are produced with the rearward, and forward feeding operations respectively. Such a sequence of stitches are produced in one cycle operation of the sewing machine which is repeated as well.

Especially as shown in FIGS. 2A, 2B and 2C all the stitches located outside of the edge of the fabric on the right side thereof, for example, the stitches (1, 6), (7, 12), (13, 18), are connected to the stitches located just inside of the edge of the fabric, for example the stitches (5, 2), (11, 8), (17, 14), and also vertically connected to each other along the edge of the fabric. Therefore, all the stitches are fixed, and the threads between the stitches will not be slackened. Thus the embodiments of the invention are all reliable providing a better hemming effect.

In this connection, the sequence of the stitches in FIGS. 3A, and 3B is as follows; The stitches from 1 to 2 and 3 are produced with the forward feeding operation of the sewing machine. The stitches from 3 to 4, 5 and 6 are produced with the rearward, forward and forward feeding operations respectively, and the stitch from 6 to 7 is produced with the rearward feeding operation. Thus these stitches are cyclically and repeatedly produced.

What is claimed as new and desired to be protected by Letters Patent is set forth in the appended claims:

1. A method of hem-stitching a fabric by a zigzag sewing machine having means for vertically and laterally reciprocating a needle cooperating with upper and lower threads, and means for feeding the fabric in two opposite directions to form lock-stitches with said threads, said method comprising the periodical steps of:

producing a fixing first stitch at one point adjacent to an edge of the fabric, with feeding the fabric in one direction while laterally moving the needle a short distance away from said one point;

producing a second stitch with feeding the fabric in the opposite direction while laterally moving the needle a larger distance away from said one point;

producing a third stitch with feeding the fabric in the one direction without lateral movement of the needle;

producing a fourth stitch with feeding the fabric in the opposite direction while laterally moving the needle about the larger distance towards said one point;

producing a fixing fifth stitch with feeding the fabric in the one direction while laterally returning the needle about said short distance into said one point; and producing a sixth stitch with feeding the fabric in the one direction without lateral movement of the needle to a subsequent point adjacent to the edge of the fabric.

2. A method as defined in claim 1 wherein said third stitch includes an additional stitch formed with feeding the fabric a short distance in the opposite direction with a short lateral movement of the needle.

3. A method as defined in claim 1, wherein said third stitch includes two additional stitches, one being formed with feeding the fabric in the opposite direction and the other with feeding the fabric in the one direction without lateral movement of the needle.

* * * * *